United States Patent [19]

Jacobsen

[11] 4,091,605

[45] May 30, 1978

[54] METHOD AND APPARATUS FOR THE TWISTING OF YARN

[76] Inventor: Alan Nicholas Jacobsen, 48 Stephenson St., Richmond, Victoria, Australia

[21] Appl. No.: 769,092

[22] Filed: Feb. 16, 1977

[30] Foreign Application Priority Data

Feb. 23, 1976 Australia ..... 4950/76

[51] Int. Cl.[2] ..... D01H 1/12

[52] U.S. Cl. ..... 57/58.89; 57/156

[58] Field of Search ..... 57/58.89, 58.95, 156

[56] References Cited

U.S. PATENT DOCUMENTS

| | | | |
|---|---|---|---|
| 2,231,815 | 2/1941 | Newman et al. | 57/58.91 |
| 2,598,185 | 5/1952 | Maxham | 57/58.91 |
| 3,488,935 | 1/1970 | Maxham | 57/58.91 |
| 3,555,802 | 1/1971 | Maxham | 57/58.89 |
| 3,688,487 | 9/1972 | Fukuta et al. | 57/58.91 X |
| 3,898,788 | 8/1975 | Fehrer | 57/58.89 X |
| 3,981,137 | 9/1976 | Fehrer | 57/58.89 X |

FOREIGN PATENT DOCUMENTS

| | | | |
|---|---|---|---|
| 880,239 | 10/1961 | United Kingdom | 57/58.89 |

*Primary Examiner*—Donald Watkins

*Attorney, Agent, or Firm*—Thompson, Birch, Gauthier & Samuels

[57] ABSTRACT

A method of spinning yarn wherein an open end assembly of fibres is drawn across a surface of revolution rotating on its axis and the assembly of fibres are caused to roll along the surface while being drawn thereacross so as to impart a uni-directional twist to the fibres to create a yarn.

15 Claims, 2 Drawing Figures

METHOD AND APPARATUS FOR THE TWISTING OF YARN

Figure 1:
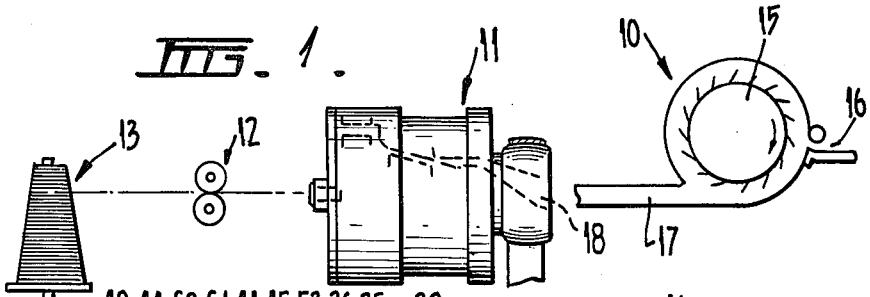

This invention relates to a method and apparatus for the spinning of textile yarn from natural, artificial or synthetic fibres.

Because of the well-known limitations of the familiar and highly developed Ring Spinning System, such as, the restricted package size, the restricted production rate and the high cost of frequent doffing; and in view of the technical difficulties, especially of yarn ballooning, and the effect of windage on the fibres, which impede the use of increased ring-spindle speeds; study has been extended to other known principles and to the development of innovative departures from the ring-spinning system.

To obtain high speed production for cost advantage emphasis has been given to the provision of high spindle and rotor speeds. High mechanical speeds however involve costly power consumption and other negative commercial and technical aspects.

The known "Open end", "Break", or "Free fibre" spinning system, as it is variously known, has been utilised in the development of various spinning methods mostly requiring the rotation of a twisting device imparting one turn in the forming yarn for each rotation of the device.

The most effective "Break", spinning system has been the "Drum" or "Rotor" type, and employs a rapidly rotated drum, at speeds up to 50,000 revolutions per minute. Apart from the drum speed, the rate of withdrawal of the forming yarn determines the number of turns per inch of yarn inserted by the rotating drum, whereas the input of fibres into the drum determines the count of the yarn. It is necessary, in drum spinning, for the fibres to be built up layer by layer in the drum as the drum rotates, while the fibre-web is simultaneously being peeled off. Some fibres become trapped in the forming yarn out of turn, and inconvenient "bridging" of the fibres tends to occur causing areas of weakness in the yarn and/or a higher than desirable incidence of yarn breakage. Especially with the production of yarns of fine counts it is possible to deliver the required mass of fibres to the drum collector at relatively higher speeds than is possible for the drum system to supply twist for the formation of the yarn. Thus the speed and operation of the system is dependent upon the twisting capacity of the machine. The fibre input system, as well as the withdrawal and winding systems, have not been operable at the speeds which could be attainable owing to the limitations of the rate of twist insertion when depending on drum speed.

The performance of the drum spinner is governed by the diameter of the drum which affects both the length of the fibre which may be spun, as well as the speed at which the drum can rotate and insert twist. High drum speeds necessary for the economy of production impose the necessity for the employment of a relatively small drum. This is due to the danger of bursting when using a larger drum at the high speed required for twist insertion commensurate with a high yarn withdrawal rate. However a relatively small drum is not suitable for the spinning of fibres of relatively longer staple length.

At higher drum speeds there is also an occurrence of a greater incidence of fibre entanglement. At high drum speeds, air turbulence increases yarn breakage rates, and detracts from yarn quality. A larger drum operating at lower speed produces optimum yarn quality and enables fibres of longer length staple to be spun, but this combination adversely affects the economy of the production of "Open End/Drum" spinning as practised hitherto.

Another spinning system, known as "Self Twist" avoids the need for an open end in the fibre delivery system, whilst obtaining the advantages, as in open end spinning, of high production and large reception packages. This system involves the use of a pair of rollers through which the drafted fibre assembly is drawn, whilst the rollers reciprocate in an axial direction relative to each other. The reciprocating movement of the rollers rolls the fibres so that twist is imparted to them. Because the movement between the rollers is reciprocatory, the direction of twist is reversed with each reciprocation of the rollers. Thus there is also, at the change of direction of the reciprocation, a short interval of time when the rollers are effectively stationary and hence no twist is applied during this interval to the withdrawing fibres. The length of this untwisted section is dependent upon the rate of the yarn withdrawal, and the speed of the reciprocation of the rollers.

The twist produced by the reciprocatory action of the rollers on the forming yarn is "false twist" i.e. the insertion of twist on the input side of the twisting mechanism is cancelled out, in the case of continuous twisting in a constant direction, on the egress side of the mechanism. The interval of zero twist separates the sections of opposing twists so long as no undue tension to the single end of yarn is applied. Thus there are produced alternate sections of "S" and "Z" twist separated by sections of zero twist.

The yarn would disassemble at the point of weakness in the section of zero twist on the application of tension such as in winding, were it not for the joining in staggered alignment, of a contiguously produced yarn, thereby to form a two-fold yarn. The opposite twists of the two ends of yarn are so arranged in the withdrawal of each from the reciprocatory rollers, that they merge together, and form a bond, as each opposing twist tends to unwind against the other. The zero twist sections of the two merging yarn ends also are not permitted to coincide in the formation, as this would create a weak untwisted section in the doubled yarn, which would give rise to yarn breakage during the further processing. The above described method of inserting twist may be satisfactory where the fibre-length is relatively long; however with shorter fibre length staples, such as cotton, the untwisted sections which may exceed the length of a single fibre, thus represent an unacceptable weakness in the yarn.

It will also be appreciated that the sections of "S" and "Z" twists, and relatively untwisted sections, can present variables in other properties of the yarn, such as its dyeing characteristics, and also impose some limitations on the end-use applications of the yarn and subsequent products.

The above described known methods of spinning yarn are only examples of the many variations on the basic known process. Further information on current practices and development can be found in the book entitled "Spinning in the '70s" by P. R. Lord, Assistant Professor, School of Textiles, North Carolina State University; published by Merrow Publishing Co. Ltd. of Watford, Herts., England.

It is an object of the present invention to provide a method and apparatus for spinning yarn, which will provide a uniform uni-directional twist at a relatively high production rate, employing the open end spinning technique without requiring unduly high mechanical speeds for twisting purposes, and without being subject to the limitations affecting drum spinning of the drum speed and drum diameter as before mentioned.

There is thus provided a method of spinning yarn by the open end spinning technique, by means of the utilisation of frictional contact between a condensed assembly of fibres and a surface to induce the assembly of fibres to roll on its axis on the surface, while being drawn thereacross, and thereby twisting the fibres together to form a spun yarn.

More particularly the method of spinning yarn comprises establishing an open end assembly of staple fibres, delivering the assembly of staple fibres in a continuous stream onto a surface of revolution, drawing the assembly of fibres across said surface from one axial end thereof to the other axial end, and effecting movement between the assembly of fibres and said surface to cause the assembly of fibres to roll about the axis thereof upon the surface whereby the fibres of the assembly are twisted together to form a yarn.

The movement between the assembly of fibres and the surface of revolution may be achieved by rotating either or both about the axis of the surface. The assembly of fibres may roll on either an internal or external surface of revolution or may even be rolled between two co-axial surfaces of revolution, one internal and one external.

In one preferred arrangement the method of spinning comprises delivering the assembly of staple fibres in a continuous stream onto a surface of revolution, drawing the assembly of fibres across said surface from a delivery point at one axial end of the surface to an exit point at the other axial end, moving the delivery and exit points relative to said surface in unison in respective circular paths co-axial with said surface to cause the assembly of fibres to roll about the axis thereof upon said surface whereby the fibres are twisted together to form a yarn.

Apparatus that may be used in the spinning of yarn by the method of this invention comprises a member having a surface of rotation, means supporting said member for rotation about the axis of said surface, means to present an assembly of fibres as an open end continuous stream to said surface of revolution, means to draw said assembly of fibres across said surface, and means to cause said assembly of fibres to roll about the axis thereof upon said surface while being drawn thereacross to twist the fibres together to form a yarn.

Conveniently the yarn end is drawn by withdrawal nip rollers which draw the condensed fibre-web into the spinner zone and across the surface of revolution while the assembly of fibres and/or the surface rotate about the axis of the surface.

In one arrangement the fibres are drafted by feeding a prepared sliver to a rotating toothed pinion and the drafted fibres are conveyed in an air stream to a venturi. The fibres are accelerated during passage through the venturi to effect further thinning of the fibre mass, to create the "break" necessary to open end spinning. The venturi delivers the thinned fibres to an axially orientated collector groove, where condensation of the fibres takes place as the fibres are being delivered continuously at a controlled rate to the groove. At this point the twisting "tail" of the already forming yarn picks up the condensed fibres from the collector groove to draw the fibres across the surface of revolution.

In practice it will be normal to coat the surface of revolution on which the assembly of fibres rolls with a material which promotes the desired frictional forces between the fibres and the surface to achieve the required rolling action of the forming yarn.

The degree of twist imparted to the forming yarn as it is drawn through the apparatus is dependent upon the diameter of the surface of revolution, the speed of rotation therof, and the speed at which the forming yarn is drawn through across the surface.

In an apparatus where the surface of revolution is of 2 inch diameter, and the theoretical count of the yarn produced is 30 cc with a yarn diameter of 0.0065 inches; the theoretical number of insertable twists per revolution of the fibre assembly around the axis of the surface of revolution would be 315 .Thus if the fibre assembly is rotated about the axis at 800 RPM the insertable twist per minute amounted to 252,000 turns. In practise the number of turns was less because of the slippage factor.

In view of the capability of this method and apparatus to impart a high number of turns per minute to the fibres, it is accordingly possible to employ a high speed of withdrawal of the yarn and still retain the required turns per inch in the finished yarn to produce a quality yarn. It will therefore be appreciated that the method and apparatus of the present invention permits high production rates without sacrifice in quality.

The invention will be more readily understood from the following description of an apparatus for spinning fibres in accordance with the prsent invention and as illustrated in the accompanying drawings.

In the drawings

Figure 2:
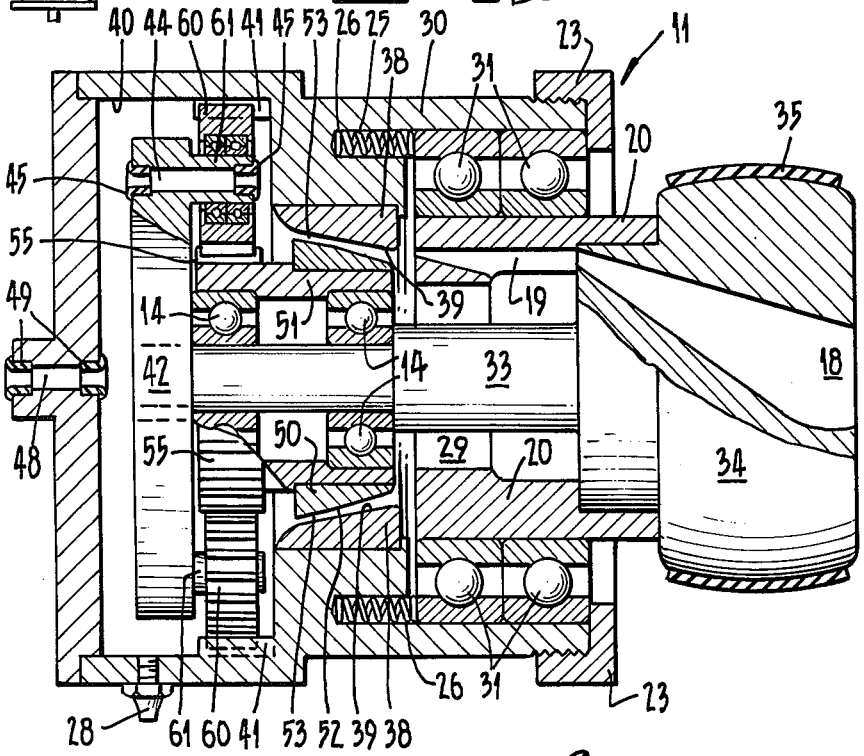

FIG. 1 is a schematic representation of the method and apparatus required to carry out the invention FIG. 2 is a longitudinal sectional view of the spinning apparatus.

Referring now to the drawings, FIG. 1 shows a drafting device 10 which delivers the fibres to the spinner 11 wherein the fibres are formed into a spun yarn and withdrawn from the spinner by the take-up rollers 12 to the yarn package 13. The drafting device 10 is of the known type employing a toothed rotor 15 and includes provision for adjusting the speed of the rotor to control the degree of drafting. It will of course be appreciated that other known forms of drafting devices may be used to obtain the required separation and rate of delivery of the fibres to the spinner 11.

In the example shown a sliver of fibres enter the drafting device at 16 and is attenuated by the toothed roller before delivery to the conveyor duct 17. It will be appreciated that the fibres are subjected to a centrifugal force inthe drafting device 10 and accordingly this force propells the attenuated fibres chain along the duct 17. However an additional air stream may be established in the duct 17 to assist the flow of the fibres, and such an auxiliary air stream has the advantage that it may be adjusted independently of the drafting device to obtain the required control of delivery of the fibres.

The fibres are delivered by the duct 17 into the venturi passage 18 of the spinner 11 wherein the speed of the fibres are accelerated as they travel through the venturi. Referring now to FIG. 2, the fibres are discharged from the venturi 18 into the axial collector groove 19 in the member 20 wherein they are condensed due to their reduced velocity in the axial direction, and also the centrifugal force encountered from the rotation of the member 20 in which the groove 19 is formed.

Before proceeding further to describe the method of spinning of the yarn as it travels through the spinner 11, the construction of the spinner will be described in greater detail.

The spinner comprises a stationary housing 30 carrying bearings 31 which rotatably support the member 20. The shaft 33 and drive member 34 are secured to the member 20 so as to also be rotatably supported by the bearings 31, and the member 20, drive member 34 and shaft 33 rotate in unison driven by the belt 35 engaging the periphery of the drive member 34.

The stationary outer yarn ring 38 is fitted to the housing 30 co-axial with the member 20 and the shaft 33, and provides an internal conical yarn rolling surface 39. Also the internal surface 40 of the housing is provided with an internal ring gear 41 also concentric with the shaft 33. The guide plate 42 is attached to the shaft 33 to rotate therewith and includes a yarn guide passage 44 displaced radially from and parallel to the axis of the shaft 33. Guide bushes 45 of suitable material are provided at each axial end of the yarn passage 44. The yarn delivery passage 48 is provided in the end of the housing co-axial with the shaft 33 and also is provided with guide bushes 49 at each axial end thereof.

The inner yarn ring 50 is secured to the sleeve 51 and rotatably supported by the bearings 14 on the shaft 33. The sleeve 51 is provided with an external gear tooth formation 55, and a pair of diametrically opposed planet gears 60 are rotatably supported on shaft 61 carried by the guide plate 42 and mesh with the ring gear 41 and the sleeve gear 55. It will be appreciated that these gears provide a planetary gear system whereby the rotation of the shaft 33 will produce a rotation of the sleeve 51 and the inner yarn ring 50. The gears are selected so that the inner yarn ring rotates in the same direction as the guide plate 42 and at twice the rotational speed thereof. The reason for this speed ratio will be explained at a later stage.

The radially spaced and oppositely tapered surfaces 39 and 52 of the outer and inner yarn rings respectively form a continuous annular passage 53 which tapers in the direction towards the guide plate 42 of the spinner. The aperture 22 in the member 20 is an axial continuation of the groove 19 and aligns with the rear end of the annular groove 53.

It will be noted that the bearings 31 supporting the member 20 and shaft 33 are held against the retaining ring 23 by a plurality of circumferentially spaced springs 25 located in respective apertures 26 in the housing 30. Accordingly by adjustment of the retaining ring 23, the member 20 and the shaft 33 may be moved axially in the housing and hence the inner yarn ring 50 would be axially moved relative to the outer yarn ring 38 and thus vary the radial width of the annular groove 53 between the inner and outer yarn rings. This adjustment is necessary to enable the one spinner to be used for producing yarns of different counts.

In order to initiate operation of the spinner a seed yarn is threaded through the delivery passage 48, the guide passage 44, the annular passage 53, the aperture 22 and groove 19. Upon initiation of the spinning operation, the tail of the seed yarn is twisted in the groove 19 by the rings and as the yarn is withdrawn from the spinner carries with it the fibres initially collected in the groove 19. These in turn are twisted by the rings and the twisting tail continuously picks up in the groove 19 the new incoming fibres to enable the continuous production of newly formed yarn.

It is to be noted that the member 20 has a substantial internal cavity 29, the purpose of which is to dramatically reduce the air speed in the spinner once the air has issued from the venturi 18, as high air speeds in this vicinity can interfere with the spinning operation. The outlet conduit 28 provided in the housing 30 may be connected to a pump to avoid the build-up of a substantial air pressure in the spinner.

In operation the drive member 34, shaft 33, member 20 and conrol plate 42 all rotate in unison at the required speed, normally of the order of 800 to 1,000 RPM. The forming yarn which extends from the passage 22 in the member 20 to the guide passage 44 is carried in a circular path by the rotating members at the same speed as those members. Having regard to the relative radial disposition of the passage 22 the outer yarn ring 38 and the guide passage 44, the rotation of the forming yarn about the axis of the shaft 33 causes that portion of the forming yarn in contact with the surface 39 of the outer yarn ring 38 to roll on the surface 39, as the friction forces between that surface and the fibres of te forming yarn are sufficient to prevent significant slippage therebetween. This rolling of the fibres of the forming yarn on the surface 39 imparts a twist to the fibres to form them into a useable yarn.

The inner yarn ring 50 as previously described, is rotated at a speed twice that of the shaft 33, and this rolling of the inner ring in contact with the forming yarn assists in the promotion of the rolling of the forming yarn to effect the necessary twisting and reduces the risk of slippage of the forming yarn on the surfaces of the inner and outer yarn rings. As the diameter of the yarn is relatively small in comparison with the diameter of the surfaces 52 and 39 of the inner and outer yarn rings 50 and 38 respectively and as the forming yarn is rotating about the axis of these surfaces whilst also rolling thereon, the inner ring must, when the outer ring 38 does not rotate, rotate at a speed twice, and in the same direction that the fibre assembly rotates about the axis of the rings. The speed at which the fibre assembly rotates about the axis of the rings is of course the speed of rotation of the member 20, guide plate 42 and shaft 33. The rotation of th inner ring 50 in this manner to assist in promoting the rolling of the fibre assembly on the outer ring without slippage is important in retaining the fibre assembly in alignment with the collector groove 19 and guide passage 44 as they rotate. This speed of the inner ring, is determined ignoring the minor difference in diameter between the surfaces of the respective rings. In some instances it may be necessary to make a minor adjustment to the speed ratio between the inner and outer rings by suitable gearing, particularly when the diameter of the forming yarn is relatively large.

The open end of the forming yarn is established at the delivery end of the venturi 18, for at this point the fibres have been accelerated to their maximum speed, substantially greater than the speed at whih they are delivered to the venturi, and accordingly the fibres are separated to their greatest extent at the discharge end of the venturi. The proportions of the venturi relative to the rate of delivery of the fibres from the drafting device are arranged so that at the discharge end of the venturi the fibres are sufficiently separated so that the twisting created by the rolling of the forming yarn is not transmitted to the fibres in the venturi and accordingly there is an effective "break" in the fibre stream to create the conventional open end to the forming yarn. The degree of separation necessary to establish the break for different fibres is known in the art of open end spinning.

Upon the delivery of the fibres to the collector groove 19, there is a substantial reduction in the speed of the fibres in the general axial direction of the spinner, and therefore there is a build-up and condensing of the fibres in the collctor groove to an extent to provide the necessary quantity of fibres corresponding to the count of yarn to be produced, and withdrawn at the rate determined by the withdrawal rollers 12.

It will be appreciated that as the control plate 42 and the member 20 rotate in unison and as the collector groove 19 and passage 44 are in the same plane radial to the axis of rotation the assembly of fibres also remain in this plane as they pass between the inner ring 50 and outer ring 38 and undergo the rolling action.

It is to be understood that the invention is not restricted to the mechanical construction of the spinner 11 as hereinbefore described and that a number of constructions can be devised in order to practise the invention. One of the principal features of the invention is that an open end assembly of fibres is established and that assembly is caused to roll on a surface as it is drawn across the surface so as to impart a uni-directional twist to the fibres. The most convenient form which the surface may take is a surface of revolution and the rolling action can then be achieved by causing the assembly of fibres to move in a circular path while in rolling contact with the surface of revolution.

The claims defining the invention are:

1. A method of spinning yarn comprising establishing an open end assembly of fibres, delivering the assembly of fibres in a continuous stream to one axial end of a surface of revolution, drawing the assembly of fibres across said surface from said one axial end to an opposite axial end while simultaneously effecting movement between the assembly of fibres and said surface to cause the assembly of fibres to roll upon the surface whereby the fibres of the assembly are twisted together to form a yarn.

2. A method of spinning yarn as claimed in claim 1 wherein the surface of revolution is rotated about the axis thereof to effect said movement between the surface and the assembly of fibres.

3. A method of spinning yarn comprising establishing an open end assembly of fibres, delivering the assembly of fibres in a continuous stream onto a surface of revolution, drawing the assembly of fibres across said surface from a delivery point at one axial end of th surface to an exit point at the other axial end, moving the delivery and exit points relative to said surface in unison in respective circular paths co-axial with said surface to cause the assembly of fibres to roll upon said surface whereby the fibres are twisted together to form a yarn.

4. A method as claimed in claim 1 wherein the surface of revolution does not rotate on the axis thereof.

5. A method as claimed in claim 4 wherein the fibres are drawn across said surface of revolution through a passage formed by said surface of revolution and a further concentric surface of revolution spaced radially therefrom.

6. A method as claimed in claim 5 wherein the passage converges in the direction of movement of the assembly of fibres across the surface.

7. A method as claimed in claim 6 wherein said surface of revolution is stationary and the further surface of revolution rotates at a rotational speed substantially equal to twice the rotational speed of the delivery and exit points with the fibre assembly in rolling contact with both surfaces of revolution.

8. A method as claimed in claim 1 wherein fibres are conveyed in an air stream to a condensing zone where at the assembly of fibres is formed, said fibres being accelerated while in said air stream to form an open end between the fibres in the condensing zone and the fibres in the air stream.

9. Apparatus for spinning yarn comprising a member having a surface of revolution, means to present an assembly of fibres as an open end continuous stream to one axial end of said surface of revolution, means operable to draw said assembly of fibres across said surface from said one axial end to an opposite axial end thereof, and means to cause said assembly to roll upon said surface while being drawn thereacross to twist the fibres together to form a yarn.

10. Apparatus as claimed in claim 9 wherein the means to cause said assembly of fibres to roll upon said surface of revolution includes guides disposed adjacent each axial end of said surfaces to guide the fibres upon said surface and guide the formed yarn upon leaving the surface, said guides being supported to rotate about the axis of said surface, and at least the guide at the exit end of the surface being disposed relative to the surface in the radial direcion to maintain the assembly of fibres extending between the guides in contact with the surface revolution.

11. Apparatus as claimed in claim 10 wherein the surface of revolution is formed on a stationary member.

12. Apparatus as claimed in claim 10 wherein the means to present the assembly of fibres includes means to entrain fibres in an airstream, and a venturi in the path of said airstream proportioned to accelerate the fibre during the passage therethrough to create an open end condition at the exit end of the venturi.

13. Apparatus as claimed in claim 12 wherein the guide at the entry end of the surface includes a collector passage extending in the axial direction, and the venturi is formed in a member supported for rotation in unison with the guides, said venturi having an inlet end co-axial with the axis of rotation and a delivery end adjacent said collector passage to delivery the fibres into said passage.

14. Apparatus as claimed in claim 9 wherein the surface of revolution is an internal surface and a further external surface of revolution is provided co-axial with he internal surface and spaced radially therefrom to form therewith an annular passage, at least one of said surfaces being mounted for rotation on its axis relative to the other of said surfaces and drive means coupled to the or each surface to effect said rotation so that there is rolling contact between the assembly of fibres and each of said surfaces.

15. Apparatus as claimed in claim 14 wherein said internal surface of revolution is stationary; and the means to cause the assembly of fibres to roll on said internal surface includes, respective members located adjacent each axial end of said internal surface and coupled to rotate in unison about the axis of said internal surface, one of said members having a collector groove extending in the axial direction and disposed to guide fibres into said annular passage, the other of said members having an axially extending guide passage spaced radially outward of the annular passage to guide the twisted assembly of fibres issuing from the annular passage, said collector groove and guide passage being located in substantially the same plane radial to the axis of said internal surface of revolution, and means to rotate said members.

* * * * *